US011629899B2

(12) United States Patent
Feng et al.

(10) Patent No.: US 11,629,899 B2
(45) Date of Patent: Apr. 18, 2023

(54) HEAT PUMP SYSTEM AND CONTROL METHOD THEREFOR

(71) Applicant: Gree Electric Appliances, Inc. of Zhuhai, Guangdong (CN)

(72) Inventors: Tao Feng, Guangdong (CN); Limin Li, Guangdong (CN); Huajie Li, Guangdong (CN); Wenhao Huang, Guangdong (CN); Peng Cao, Guangdong (CN); Mengmeng Jin, Guangdong (CN); Chao Zhou, Guangdong (CN); Shiqiang Zhu, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 246 days.

(21) Appl. No.: 16/960,952

(22) PCT Filed: Dec. 14, 2018

(86) PCT No.: PCT/CN2018/121048
§ 371 (c)(1),
(2) Date: Jul. 9, 2020

(87) PCT Pub. No.: WO2019/141029
PCT Pub. Date: Jul. 25, 2019

(65) Prior Publication Data

US 2020/0370808 A1 Nov. 26, 2020

(30) Foreign Application Priority Data

Jan. 17, 2018 (CN) ..... 201810042733.X

(51) Int. Cl.
*F24F 1/0059* (2019.01)
*F25B 47/02* (2006.01)
(Continued)

(52) U.S. Cl.
CPC ..... *F25B 40/00* (2013.01); *F24F 1/0059* (2013.01); *F25B 30/02* (2013.01); *F25B 41/20* (2021.01);
(Continued)

(58) Field of Classification Search
CPC ..... F24F 1/0059; F25B 30/02; F25B 47/02; F25B 49/025; F25B 2300/00;
(Continued)

(56) References Cited

U.S. PATENT DOCUMENTS 4,774,813 A 10/1988 Yokoyama
2005/0284174 A1 12/2005 Nakajima
(Continued)

FOREIGN PATENT DOCUMENTS

CN 103363710 A 10/2013
CN 103743156 A 4/2014
(Continued)

OTHER PUBLICATIONS

English language translation of CN 103743156 (Year: 2014).*

*Primary Examiner* — Cassey D Bauer
(74) *Attorney, Agent, or Firm* — The Webb Law Firm

(57) ABSTRACT

A heat pump system and a control method therefor. The heat pump system includes a compressor; an indoor heal exchanger; an outdoor heat exchanger, including a first heat exchange portion and a second heat exchange portion, wherein a flow path switching device is provided between the first heat exchange portion and the second heat exchange portion to disconnect or communicate the first heat exchange portion and the second heat exchange portion; a first four-way valve; and a second four-way valve, configured to enable a high-temperature refrigerant to be input into the
(Continued)

first heat exchange portion in a heating mode, so as to enable the heat pump system to operate in a heating and deicing mode.

20 Claims, 6 Drawing Sheets

(51) Int. Cl.

| | |
|---|---|
| ***F25B 41/20*** | (2021.01) |
| ***F25B 41/42*** | (2021.01) |
| ***F25B 40/00*** | (2006.01) |
| ***F25B 30/02*** | (2006.01) |
| ***F25B 49/02*** | (2006.01) |

(52) U.S. Cl.
CPC ..... *F25B 47/02* (2013.01); *F25B 49/025* (2013.01); *F25B 41/42* (2021.01); *F25B 2300/00* (2013.01)

(58) Field of Classification Search
CPC ..... F25B 2339/0444; F25B 2400/13; F25B 2600/2509; F25B 2313/02742
See application file for complete search history.

(56) References Cited

U.S. PATENT DOCUMENTS

| | | | | |
|---|---|---|---|---|
| 2014/0245766 | A1 | 9/2014 | Wakamoto et al. | |
| 2014/0318165 | A1* | 10/2014 | Kanazawa ..... | F25B 30/02 62/238.6 |

FOREIGN PATENT DOCUMENTS

| | | | |
|---|---|---|---|
| CN | 205784048 | U | 12/2016 |
| CN | 108362027 | A | 8/2018 |
| CN | 208186896 | U | 12/2018 |
| EP | 2884205 | A1 | 6/2015 |
| EP | 3112781 | A1 | 1/2017 |
| EP | 3203165 | A1 | 8/2017 |
| JP | 2014085098 | A | 5/2014 |

* cited by examiner

HEAT PUMP SYSTEM AND CONTROL METHOD THEREFOR

CROSS-REFERENCE TO RELATED APPLICATIONS

This application is the United States national phase of International Application No. PCT/CN2018/121048 filed Dec. 14, 2018, and claims priority to Chinese Patent Application No. 201810042733.X filed Jan. 17, 2018, the disclosures of which are hereby incorporated by reference in their entirety.

BACKGROUND OF THE INVENTION

Field of the Invention

The disclosure relates to the technical field of heat pumps, in particular to a heat pump system and a control method therefor.

Description of Related Art

When a heat pump system (such as a heat pump type air conditioner or a heat pump type water heater) operates in winter (particularly in winter in a cold region), the heat pump system operates in a heating mode for a long time, an outdoor heat exchanger serves as an evaporator, and the surface temperature of the outdoor heat exchanger is lower than 0 DEG C. due to the fact that the outside is always cold, moist and low in air temperature, so that gaseous wet air in outdoor air is condensed into frost, the frost may fully cover the whole outdoor heat exchanger under guidance of an outer fan to block heat exchange between the heat exchanger and the outdoor air, and thus an outdoor unit cannot absorb heat from the outside. Taking the air conditioner as an example, such situation may result in decrease of outlet temperature of an indoor unit and even inability to generate any hot air, so that user comfort becomes poor, and meanwhile, the safety of the unit is also harmed.

Therefore, in the heating mode, when a defrosting condition is met (for example the device enters a defrosting mode after a detection value of an outdoor defrosting temperature sensor is less than a certain value), a four-way valve in the heat pump system is reversed, so that the system is switched into a cooling mode from a heating mode; once reversing of the four-way valve is finished, the outdoor heat exchanger becomes a condenser; the outdoor heat exchanger directly receives a high-temperature and high-pressure gaseous refrigerant exhausted by a compressor, so that heat dissipated by the high-temperature refrigerant melts frost attached to the outdoor heat exchanger, liquid water is formed and flows out of the outdoor heat exchanger, a steady heat exchange of the outdoor heat exchanger is guaranteed, and therefore when the heat pump system enters the heating mode again, the outdoor heat exchanger can fully absorb heat from an outdoor environment, and the outlet temperature of the indoor unit is guaranteed. The frost molten during a defrosting process may become water to be drained to the lower side of the outdoor heat exchanger, for example, the water flows to a water pan of the outdoor unit, and then flows away via drain hole on the water pan. In cold regions such as the northeast, northwest and northern China, the possibility of a sudden temperature drop occurs, for example, when the temperature is close to 0 DEG C. in the daytime, rainfall such as rain and snow mixed may occur, but the temperature drops suddenly at night and ice formed by rain and snow may block the drain hole and be accumulated on a base plate, and at the moment, although the outdoor unit has a defrosting process, water cannot be drained normally because the drain hole is blocked by the ice, and the water generated by defrosting becomes ice again at the bottom of the outdoor heat exchanger, so that a frost layer continuously grows on the outdoor heat exchanger, heat exchange of the outdoor heat exchanger is finally affected, and such phenomenon may greatly affect heat exchange performance and reliability of the system.

SUMMARY OF THE INVENTION

Based on the current situation, the present disclosure mainly aims at providing a heat pump system and a control method therefor, which can effectively eliminate ice at the bottom of an outdoor heat exchanger when the heat pump system operates in a heating mode, so that the problem of ice blockage of the outdoor heat exchanger caused by freezing at drain hole of an outdoor unit is solved, and a heating and deicing mode is realized.

In order to achieve the purpose, the technical scheme adopted by the present disclosure is as follows:

according to a first aspect of the present disclosure, a heat pump system includes: a compressor; an indoor heat exchanger; an outdoor heat exchanger, including a first heat exchange portion and a second heat exchange portion, wherein a flow path switching device is provided between the first heat exchange portion and the second heat exchange portion to disconnect or communicate the first heat exchange portion and the second heat exchange portion; a first four-way valve, configured to switch the flow direction of a refrigerant between the outdoor heat exchanger and the indoor heat exchanger; and a second four-way valve, configured to enable a high-temperature refrigerant to be introduced into the first heat exchange portion in a heating mode, so as to enable the heat pump system to operate in a heating and deicing mode.

In some embodiments, the compressor is provided with an enhanced vapor injection port and an inlet port, and in the heating and deicing mode, the second four-way valve is configured to enable the first heat exchange portion to be connected between the enhanced vapor injection port and the inlet port; and/or the first heat exchange portion is positioned at the bottom of the outdoor heat exchanger, and the second heat exchange portion is positioned above the first heat exchange portion.

In some embodiments, the second four-way valve is provided with a first port, a second port, a third port and a fourth port, wherein the first port communicates with the enhanced vapor injection port, the second port and the fourth port respectively communicate with two ends of the first heat exchange portion, and the third port communicates with the inlet port.

In some embodiments, the flow path switching device includes a first three-way reversing valve arranged at a first end of the first heat exchange portion, and a second three-way reversing valve arranged at a second end of the first heat exchange portion; and/or a throttling member is arranged between the third port and the inlet port.

In some embodiments, a collecting pipe is arranged at a first end of the outdoor heat exchanger, the collecting pipe communicates with the second heat exchange portion, the first end of the first heat exchange portion is configured to communicate with the collecting pipe in a first state of the first three-way reversing valve, and the first end of the first heat exchange portion is configured to communicate with the second port of the second four-way valve in a second state of the first three-way reversing valve; and/or a flow divider is arranged at a second end of the outdoor heat exchanger, the flow divider communicates with the second heat exchange portion, the second end of the first heat exchange portion communicates with a splitting branch of the flow divider in a first state of the second three-way reversing valve, and the second end of the first heat exchange portion communicates with the fourth port of the second four-way valve in a second state of the second three-way reversing valve.

In some embodiments, the second heat exchange portion includes a plurality of heat exchange pipes in parallel; and a first end of each heat exchange pipe communicates with the collecting pipe, and/or a second end of each heat exchange pipe communicates with a splitting branch of the flow divider.

In some embodiments, a throttling element is arranged in each splitting branch of the flow divider.

In some embodiments, the heat pump system also includes a supercooler provided with a first passage and a second passage; a first end and a second end of the first passage communicate with the outdoor heat exchanger and the indoor heat exchanger respectively; a first end of the second passage communicates with the fourth port of the second four-way valve; and a second end of the second passage communicates with the second end of the first passage via a supercooler throttling element.

In some embodiments, a first throttling component is arranged between the supercooler and the outdoor heat exchanger, and/or a second throttling component is arranged between the supercooler and the indoor heat exchanger.

In some embodiments, a first stop valve and a second stop valve are arranged at two ends of the indoor heat exchanger respectively; and/or a vapor-liquid separator is arranged between the inlet port and the first four-way valve.

According to a second aspect of the present disclosure, a method for controlling a heat pump system mentioned above includes following steps:

S10, enabling the heat pump system to operate in a heating mode; and

S30, switching the flow path switching device to a state to disconnect the first heat exchange portion and the second heat exchange portion, switching the second four-way valve to a state to input a high-temperature refrigerant into the first heat exchange portion, so as to enable the heat pump system to operate in a heating and deicing mode.

In some embodiments, a first port of the second four-way valve communicates with an enhanced vapor injection port of the compressor, a second port and a fourth port of the second four-way valve communicate with two ends of the first heat exchange portion respectively, and a third port of the second four-way valve communicates with an inlet port of the compressor; and in the step S30, switching the second four-way valve to the state includes enabling the first port and the second port to communicate with each other in the second four-way valve, and the third port and the fourth port to communicate with each other in the second four-way valve.

In some embodiments, between the step S10 and the step S30, the method also includes following step:

S20, enabling the heat pump system to operate in a defrosting mode: switching the flow path switching device to a state to communicate the first heat exchange portion and the second heat exchange portion, switching the first four-way valve to a state to change the flow direction of the refrigerant; and switching the first four-way valve to a state to operate in the heating mode after first predetermined time, and then executing the step S30.

In some embodiments, the step S30 includes: in the heating and deicing mode, detecting the temperature T of a component positioned on the lower side of the outdoor heat exchanger, and comparing the temperature T with a preset temperature value a; and under the condition that T is not less than a is always met within second predetermined time, executing following step:

S40, exiting the heating and deicing mode and returning to the heating mode.

In some embodiments, the second predetermined time is 30-300 s; and/or the preset temperature value is 0.5-2 DEG C.

In some embodiments, the step S10 includes:

switching the flow path switching device to a state to communicate the first heat exchange portion and the second heat exchange portion; and/or switching the second four-way valve to a state to enable the first port and the fourth port to communicate with each other in the second four-way valve, and the third port and the second port communicate with each other in the second four-way valve.

In some embodiments, the method includes the step of enabling the heat pump system to operate in a cooling mode, which includes:

switching the flow path switching device to a state to communicate the first heat exchange portion and the second heat exchange portion; and/or switching the second four-way valve to a state to enable the first port and the second port to communicate with each other in the second four-way valve, and the third port and the fourth port to communicate with each other in the second four-way valve.

The heat pump system provided by the present disclosure may conveniently achieve heating and deicing under a low-temperature condition, and guarantee that ice layers at the bottom of the outdoor heat exchanger are molten under a low-temperature heating condition, so that drain hole in the lower side of the outdoor heat exchanger can drain water normally; and at the same time, under a normal cooling or heating mode, the branches of the outdoor heat exchanger are not occupied so as to ensure a normal heat exchange area and heat exchange capacities.

Specifically, a part of heat exchange pipes at the bottom of the outdoor heat exchanger and the other heat exchange pipes can be separated in the heat pump system of the present disclosure, and the high-temperature refrigerant is introduced into the part of the heat exchange pipes at the bottom of the outdoor heat exchanger to melt ice on the base plate of the outdoor unit by switching the states of the second four-way valve, so that a defrosting effect of the outdoor heat exchanger can be reinforced during and after a defrosting process.

BRIEF DESCRIPTION OF THE DRAWINGS

The following will introduce some embodiments according to a heat pump system and a control method therefor provided by the present disclosure in reference to the drawings. In Figures.

DESCRIPTION OF THE INVENTION

Figure 1:
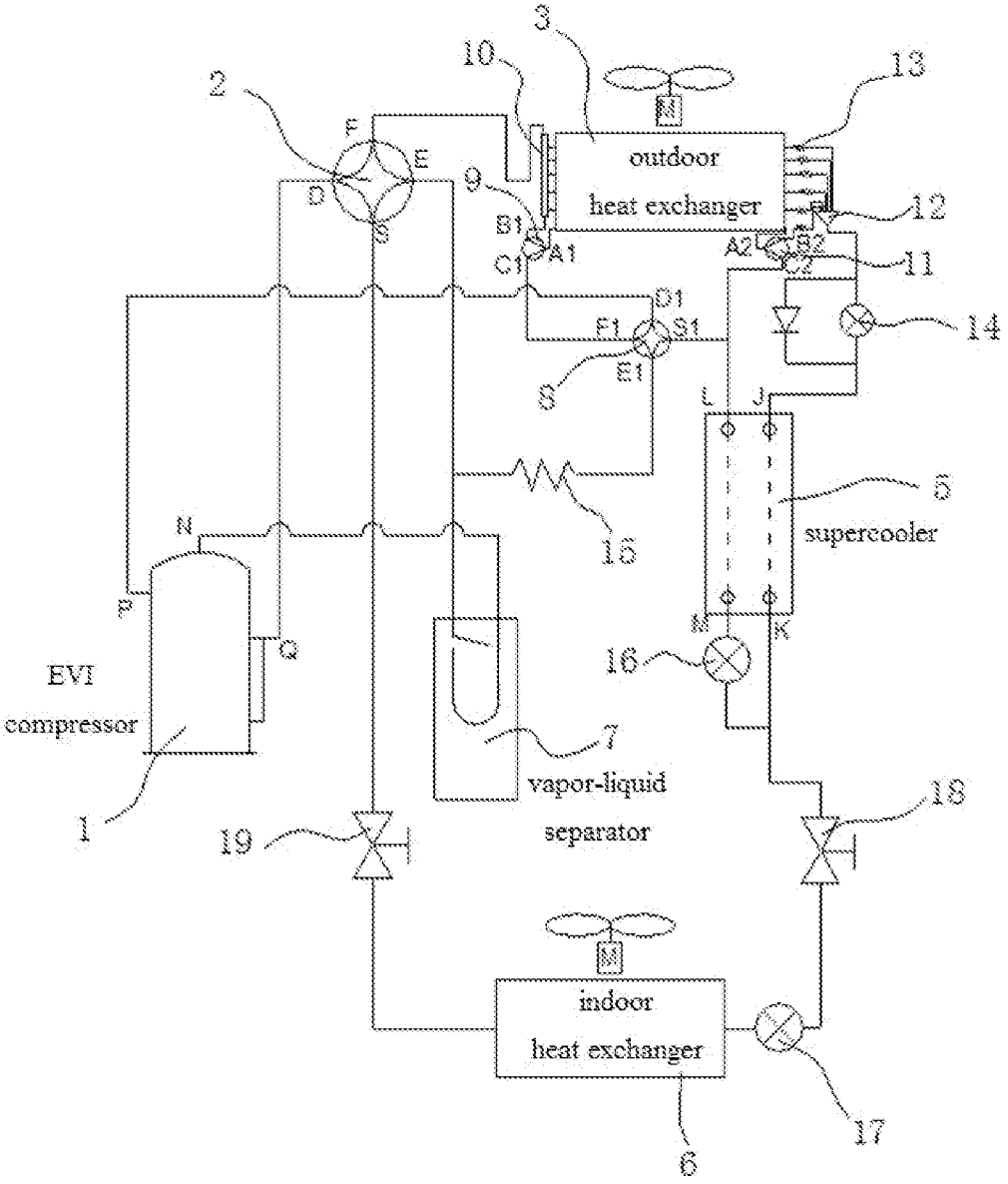
FIG. 1 is a schematic diagram of a heat pump system according to the some embodiments of the present disclosure.

Once a heat pump system (such as a heat pump type air conditioner) enters a defrosting mode, an indoor unit no longer serves as a condenser and becomes an evaporator due to reversing of a four-way valve, its temperature becomes lower. At the moment, in order not to reduce the indoor temperature, a fan of the indoor unit needs to be closed to prevent cold wind blowing indoors. But while doing so, a heat source, from which the evaporator gets heat, is closed, and at the moment, heat of condensation is only equivalent to heat generated by wasted work of the compressor (but in a cooling cycle, the heat of condensation is equivalent to the sum of heat absorbed by the evaporator and heat generated by the wasted work of the compressor), so that it is important to increase the wasted work of the compressor aiming at reducing defrosting time.

However, at present, outdoor units of many heat pump systems use common inverter scroll compressors with high-pressure chamber, that is an outdoor unit includes an inverter scroll compressor without enthalpy-adding function. And compared with an inverter scroll compressor with enthalpy-adding function, the inverter scroll compressors without enthalpy-adding function has the disadvantages of lower capability in same frequency, lower energy efficiency in same capability, higher exhaust temperature in high frequency, lower heating capability under a low-temperature working condition and the like.

Therefore, an ultra-low temperature heat pump air conditioning system for cold regions is provided in related technologies known by inventor, can not only effectively reduce environmental pollution, but also improve the energy efficiency. An enhanced vapor injection (EVI) multi-split unit is a novel multi-split unit developed aiming at high energy efficiency and high heating capability, the main part of the multi-split unit is the EVI compressor, and the system has following advantages:

1, An enhanced vapor injection multi-split unit is provided and mainly improves the heating capability. Basal principle of improving the heating capability is as follows: in a heating and enhanced vapor injection mode, in combination with a systematic design with an economizer, the enthalpy difference between an inlet and an outlet of the evaporator can be improved, the flow of the refrigerant at an outlet of the compressor can be increased, and the working capacity of a compression process can be improved, so that the heating capacity of the system is significantly increased. Meanwhile, enhanced vapor injection is used, so that the exhaust temperature can be effectively reduced, the compressor can be protected, and the service life of the system can be prolonged.

2, Cooling and supercooling or dual-mode with enhanced vapor injection means and an economizer are provided and mainly improves the cooling capability. Basal principle of improving the cooling capability as follows: in a cooling mode, liquid from the condenser is further cooled via a supercooler, so that a supercooling degree is increased, the enthalpy difference between the inlet and the outlet of the evaporator is improved, more heat is absorbed from an indoor environment, and thus the indoor temperature is reduced, and the purpose of improving the cooling capability is achieved.

However, although the enhanced vapor injection multi-split unit is high in heating capacity under the low-temperature working condition, the problem of ice blockage of the outdoor heat exchanger caused by icing at the drain hole of the outdoor unit is still difficult to solve under the low-temperature working condition.

Therefore, the first aspect of the present disclosure provides a heat pump system capable of solving the above-mentioned problems; the heat pump system optionally is an enhanced vapor injection multi-split unit, may also be other machine types.

As shown in FIG. 1, the heat pump system of the present disclosure includes a compressor 1, a first four-way valve 2, a second four-way valve 8, an outdoor heat exchanger 3 and an indoor heat exchanger 6. The compressor 1 optionally is an EVI compressor provided with an exhaust port Q, an enhanced vapor injection port P (namely a port of a medium-pressure cavity of the compressor) and an inlet port N, and the heat pump system optionally is an enhanced vapor injection heat pump system. The first four-way valve 2 is a main four-way valve and configured to switch the flow direction of a refrigerant between the outdoor heat exchanger 3 and the indoor heat exchanger 6 to change the operating mode of the heat pump system, such as a cooling mode or a heating mode. The first four-way valve 2 is provided with a first port D, a second port F, a third port E and a fourth port S. The first port D communicates with the exhaust port Q, the second port F communicates with the outdoor heat exchanger 3, the third port E communicates with the inlet port N (optionally communicates with the inlet port N via a vapor-liquid separator 7), and the fourth port S communicates with the indoor heat exchanger 6.

Figure 7:
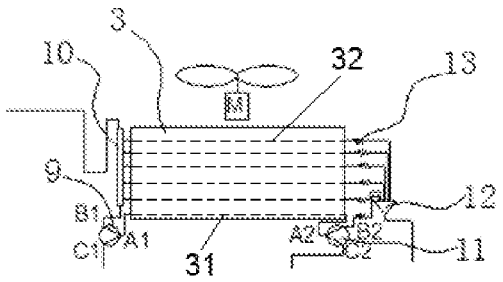
FIG. 7 is a schematic diagram of outdoor heat exchanger of a heat pump system according to some embodiments of the present disclosure.

The outdoor heat exchanger 3 includes a first heat exchange portion 31 and a second heat exchange portion 32 (not show in detail in FIGS. 1-5, see FIG. 7). The first heat exchange portion is optionally positioned at the bottom of the outdoor heat exchanger, the second heat exchange portion is optionally positioned above the first heat exchange portion, and a flow path switching device is provided between the first heat exchange portion and the second heat exchange portion and configured to disconnect or communicate the first heat exchange portion and the second heat exchange portion, so that the first heat exchange portion can communicate with the second heat exchange portion to jointly serve as an evaporator or condenser, and can also not communicate with the second heat exchange portion, and refrigerants with different properties are respectively introduced into the first heat exchange portion and the second heat exchange portion. The second four-way valve 8 is configured to introduce a high-temperature refrigerant (namely the high-temperature refrigerant provided by the compressor) into the first heat exchange portion in a heating mode, so that the heat pump system enters a heating and deicing mode. That is, two ports of the second four-way valve 8 are connected to two ends of the first heat exchange portion, and the other two ports of the same can be, for example, connected to the other branches in the heat pump system, so that when the second four-way valve 8 is in a certain state in the heating mode, the high-temperature refrigerant in the heat pump system can smoothly flow to the first heat exchange portion.

The heat pump system provided by the present disclosure may conveniently achieve a low-temperature heating and deicing function, and guarantees that ice layers at the bottom of the outdoor heat exchanger are molten under a low-temperature heating condition, so that drain hole in the bottom of the outdoor heat exchanger can drain water normally; and at the same time, in a normal cooling or heating mode, the branches of the outdoor heat exchanger are not occupied so as to ensure a normal heat exchange area and heat exchange capacities.

Specifically, a part of heat exchange pipes (such as the lowermost heat exchange pipe, namely the heat exchange pipe closest to the water pan of the outdoor unit) at the bottom of the outdoor heat exchanger and the other heat exchange pipes can be separated in the heat pump system of the present disclosure, and the high-temperature refrigerant is input into the part of the heat exchange pipes at the bottom of the outdoor heat exchanger to melt ice on the base plate of the outdoor unit by switching the states of the second four-way valve, so that a defrosting effect of the outdoor heat exchanger can be reinforced during and after a defrosting process.

Optionally, in the heating and deicing mode, the second four-way valve 8 enables the first heat exchange portion to be connected between the enhanced vapor injection port P and the inlet port N, so that a medium-pressure high-temperature gaseous refrigerant is ejected from a medium-pressure cavity of the compressor 1, to flow to the first heat exchange portion via the second four-way valve 8, and after heat exchange is realized at the bottom of the outdoor heat exchanger by releasing heat of condensation, the refrigerant further flows back to the inlet port N of the compressor via the second four-way valve 8.

Optionally, as shown in FIG. 1, the second four-way valve 8 is provided with a first port D1, a second port F1, a third port E1 and a fourth port S1, wherein the first port D1 communicates with the enhanced vapor injection port P, the second port F1 and the fourth port S1 respectively communicate two ends of the first heat exchange portion, and the third port E1 communicates with the inlet port N (optionally communicates with the inlet port N via a vapor-liquid separator 7), namely communicates with the third port E of the first four-way valve 2. Therefore, in the heating and deicing mode, the first port D1 and the second port F1 of the second four-way valve 8 communicate with each other in the second four-way valve, and the third port E1 and the fourth port S1 communicate with each other in the second four-way valve.

Optionally, a throttling member 15, optionally a capillary pipe, is arranged between the third port E1 of the second four-way valve 8 and the inlet port N, and the throttling member 15 is optionally arranged on the upstream side of the vapor-liquid separator 7.

Optionally, as shown in FIG. 1, the flow path switching device include a first three-way reversing valve 9 arranged at a first end (left end in the figure) of the first heat exchange portion and a second three-way reversing valve 11 arranged at a second end (right end in the figure) of the first heat exchange portion. Disconnecting and communicating the first heat exchange portion and the second heat exchange portion and disconnecting and communicating the first heat exchange portion and the second four-way valve 8 can be conveniently realized through switching the states of the first three-way reversing valve 9 and the second three-way reversing valve 11.

Optionally, as shown in FIG. 1, a collecting pipe 10 is arranged at a first end (left end in the figure, such as the end connected with the first four-way valve 2) of the outdoor heat exchanger 3, and the collecting pipe 10 communicates with the second heat exchange portion. When the first three-way reversing valve 9 is switched to a first state, a first end of the first heat exchange portion communicates with the collecting pipe 10, namely communicates with the second heat exchange portion; and when the first three-way reversing valve is switched to a second state, the first end of the first heat exchange portion communicates with the second port F1 of the second four-way valve 8. Specifically, the first three-way reversing valve 9 is provided with a first port A1, a second port B1 and a third port C1. The first port A1 communicates with the first end of the first heat exchange portion, the second port B1 communicates with the collecting pipe 10, and the third port C1 communicates with the second port F1 of the second four-way valve 8. When the first three-way reversing valve 9 is switched to a first state, the first port A1 and the second port B1 communicate with each other in the first three-way reversing valve; and when the first three-way reversing valve 9 is switched to a second state, the first port A1 and the third port C1 communicate with each other in the first three-way reversing valve.

Optionally, as shown in FIG. 1, a flow divider 12 is arranged at a second end (right end in the figure) of the outdoor heat exchanger 3; the flow divider, for example, includes a plurality of splitting branches respectively communicate with a plurality of heat exchange pipes (including heat exchange pipes of the second heat exchange portion and heat exchange pipes of the first heat exchange portion) in the outdoor heat exchanger 3, namely, the flow divider 12 communicates with the second heat exchange portion. When the second three-way reversing valve 11 is switched to a first state, a second end of the first heat exchange portion communicates with one splitting branch of the flow divider 12; and when the second three-way reversing valve 11 is switched to a second state, the second end of the first heat exchange portion communicates with the fourth port S1 of the second four-way valve 8. Specifically, the second three-way reversing valve 9 is provided with a first port A2, a second port B2 and a third port C2. The first port A2 communicates with the second end of the first heat exchange portion, the second port B2 communicates with one splitting branch of the flow divider 12, and the third port C2 communicates with the fourth port S2 of the second four-way valve 8. When the second three-way reversing valve 11 is switched to the first state, the first port A2 and the second port B2 communicate with each other in the second three-way reversing valve; and when the second three-way reversing valve 9 is switched to the second state, the first port A2 and the third port C2 communicate with each other in the second three-way reversing valve.

When the first three-way reversing valve 9 and the second three-way reversing valve 11 are simultaneously switched to the first states, the first heat exchange portion and the second heat exchange portion are connected in parallel and can jointly serve as an evaporator or a condenser; and when the first three-way reversing valve 9 and the second three-way reversing valve 11 are simultaneously switched to the second states, the first heat exchange portion and the second heat exchange portion are disconnected from each other, and the high-temperature refrigerant can be independently input into the first heat exchange portion for heating and deicing.

Optionally, the second heat exchange portion includes a plurality of heat exchange pipes in parallel; a first end of each heat exchange pipe communicates with the collecting pipe 10, a second end of each heat exchange pipe communicates with one splitting branch of the flow divider 12.

Optionally, as shown in FIG. 1, a throttling element 13, optionally a capillary pipe, is arranged on each splitting branch of the flow divider 12.

Optionally, as shown in FIG. 1, the heat pump system provided by the present disclosure includes a supercooler 5 provided with a first passage and a second passage; a first end J of the first passage communicates with the outdoor heat exchanger 3, for example communicates with the outdoor heat exchanger 3 via the flow divider 12; and a second end K of the first passage communicates with the indoor heat exchanger 6. A first end L of the second passage communicates with the fourth port S1 of the second four-way valve 8, namely simultaneously communicates with the third port C2 of the second three-way reversing valve 11; and a second end M of the second passage communicates with the second end K of the first passage via a supercooler throttling member (optionally a supercooler electronic expansion valve), namely simultaneously communicates with the indoor heat exchanger 6.

Optionally, as shown in FIG. 1, a first throttling component 14, such as a heating electronic expansion valve, is arranged between the supercooler 5 and the outdoor heat exchanger 3, optionally arranged between the first end J of the first passage of the supercooler 5 and the flow divider 12. A second throttling component 17, such as an indoor unit electronic expansion valve, is arranged between the supercooler 5 and the indoor heat exchanger 6.

Optionally, as shown in FIG. 1, a first stop valve 18 and a second stop valve 19 are arranged at two ends of the indoor heat exchanger 6 respectively. For example, the first stop valve 18 is optionally arranged between the second throttling component 17 and the supercooler 5, and the second stop valve 19 is optionally arranged between the indoor heat exchanger 6 and the fourth port S of the first four-way valve 2.

A vapor-liquid separator 7 is arranged between the inlet port N of the compressor 1 and the third port E of the first four-way valve 2.

The heat pump system provided by the present disclosure achieves reversing of the flow direction of refrigerant via the switching the states of the second four-way valve 8, the first three-way reversing valve 9 and the second three-way reversing valve 11, namely achieving the purpose that the heat exchange area of the outdoor heat exchanger 3 is not occupied in the cooling, heating and defrosting modes, switching states is achieved in the heating and deicing mode, and meanwhile, the normal operating effects of cooling and heating are not affected.

The operating principle and refrigerant flow direction of the heat pump system in each mode provided by the some embodiments of the present disclosure are described below with reference to FIGS. 2-5.

Figure 2:
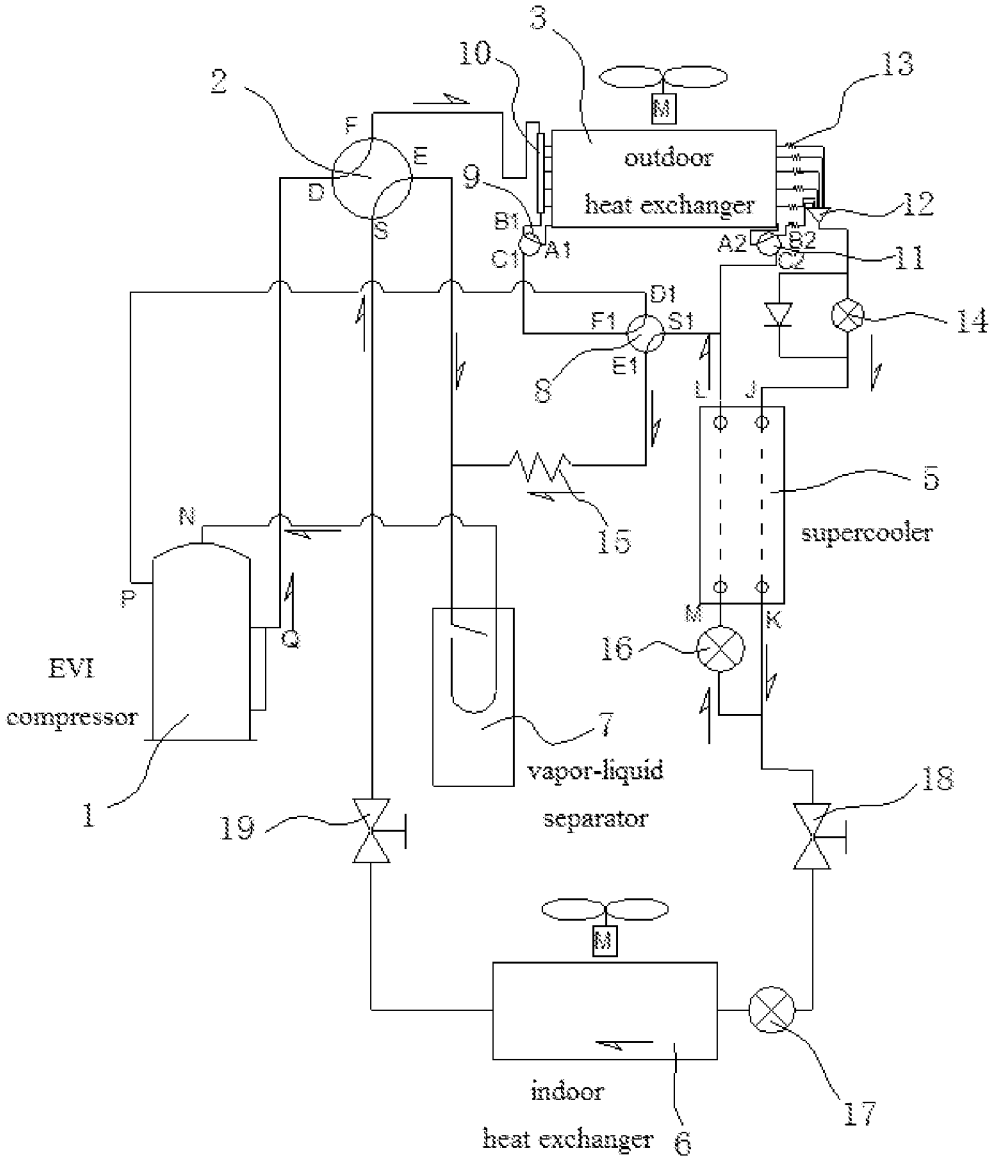
FIG. 2 illustrates the flow direction of a refrigerant of the heat pump system of FIG. 1 in a cooling mode.

As shown in FIG. 2, in the cooling mode, the first port D and the second port F of the first four-way valve 2 communicate with each other in the first four-way valve, and the third port E and the fourth port S communicate with each other in the first four-way valve; the first port D1 and the second port F1 of the second four-way valve 8 communicate with each other in the second four-way valve, and the third port E1 and the fourth port S1 communicate with each other in the second four-way valve; the first port A1 and the second port E1 of the first three-way reversing valve 9 communicate with each other in the first three-way reversing valve, and the first port A2 and the second port B2 of the second three-way reversing valve 11 communicate with each other in the second three-way reversing valve. At the moment, the outdoor heat exchanger 3 is entirely used for condensing and dissipating heat, namely, the branches of the first heat exchange portion are not occupied. The flow direction of the refrigerant is shown by arrows in FIG. 2. The refrigerant exhausted by the EVI compressor 1 flows to the outdoor heat exchanger 3 via the first four-way valve 2, and then enters the supercooler 5 after passing through the heating electronic expansion valve (namely the first throttling component 14). The refrigerant is divided into two parts in the supercooler 5. One part passes through the first passage of the supercooler 5 and the indoor unit electronic expansion valve (namely the second throttling component 17) in sequence, enters the indoor heat exchanger 6, further enters the vapor-liquid separator 7 via the first four-way valve 2, and finally flows to the inlet port N of the compressor 1 to return to the compressor 1, thereby completing a primary cycle once. And the other part is a part of the medium-temperature high-pressure refrigerant which flows out from the first passage of the supercooler 5, becomes the low-temperature low-pressure gaseous refrigerant (simultaneously cools refrigerant in the first passage of the supercooler 5, and improve a supercooling degree) under the throttling and depressurizing effect of the supercooler throttling element (namely the supercooler electronic expansion valve) 16, and then flows to the vapor-liquid separator 7 via the second four-way valve 8. In such mode, the enhanced vapor injection port P of the compressor 1 communicates with the third port C1 of the first three-way reversing valve 9 via the first port D1 and the second port F1 of the second four-way valve; and since the third port C1 is in a cut-off state, no refrigerant flows in the enhanced vapor injection port P of the compressor 1, so that the enhanced vapor injection P does not work.

Figure 3:
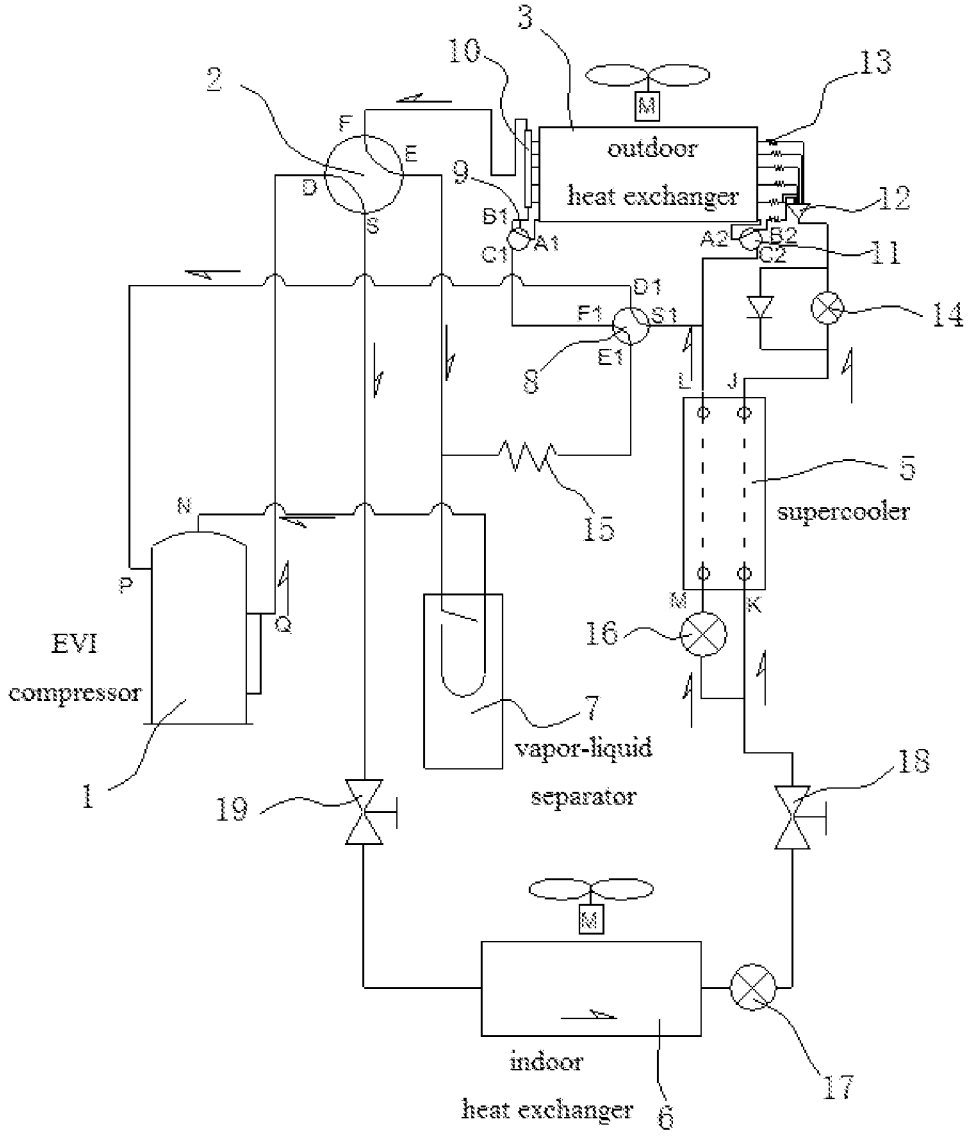
FIG. 3 illustrates the flow direction of a refrigerant of the heat pump system of FIG. 1 in a heating mode.

As shown in FIG. 3, in the normal heating mode (can also be called as the heating and non-deicing mode), the first port D and the fourth port S of the first four-way valve 2 communicate with each other in the first four-way valve, and the third port E and the second port F communicate with each other in the first four-way valve; the first port D1 and the fourth port S1 of the second four-way valve 8 communicate with each other in the second four-way valve, and the third port E1 and the fourth port F1 communicate with each other in the second four-way valve; the first port A1 and the second port B1 of the first three-way reversing valve 9 communicate with each other in the first three-way reversing valve, and the first port A2 and the second port E2 of the second three-way reversing valve 11 communicate with each other in the second three-way reversing valve. At the moment, the outdoor heat exchanger 3 is entirely used for evaporating and absorbing heat, namely, the branches of the first heat exchange portion are not occupied. The flow direction of the refrigerant is shown by arrows in FIG. 3. The refrigerant exhausted by the EVI compressor 1 flows to the indoor heat exchanger 6 via the first four-way valve 2, and then enters the supercooler 5; the refrigerant is divided into two parts in the supercooler 5. One part enters the outdoor heat exchanger 3 after passing through the first passage of the supercooler 5, further enters the vapor-liquid separator 7 after passing through the first four-way valve 2, and finally flows to the inlet port N of the compressor 1 to return to the compressor 1, thereby completing a primary cycle once. And the other part passes through the supercooler throttling element (namely the supercooler electronic expansion valve) 16, and reaches the enhanced vapor injection port P of the compressor 1 after passing through the fourth port S1 and the first port D1 of the second four-way vale 8, namely, the part of the medium-temperature high-pressure refrigerant becomes the low-temperature low-pressure gaseous refrigerant under the throttling and depressurizing effect of the supercooler throttling element (namely the supercooler electronic expansion valve) 16, and is injected to a medium-pressure cavity of the compressor 1 via the second four-way valve 8, thereby improving the capacity of the compressor.

Figure 4:
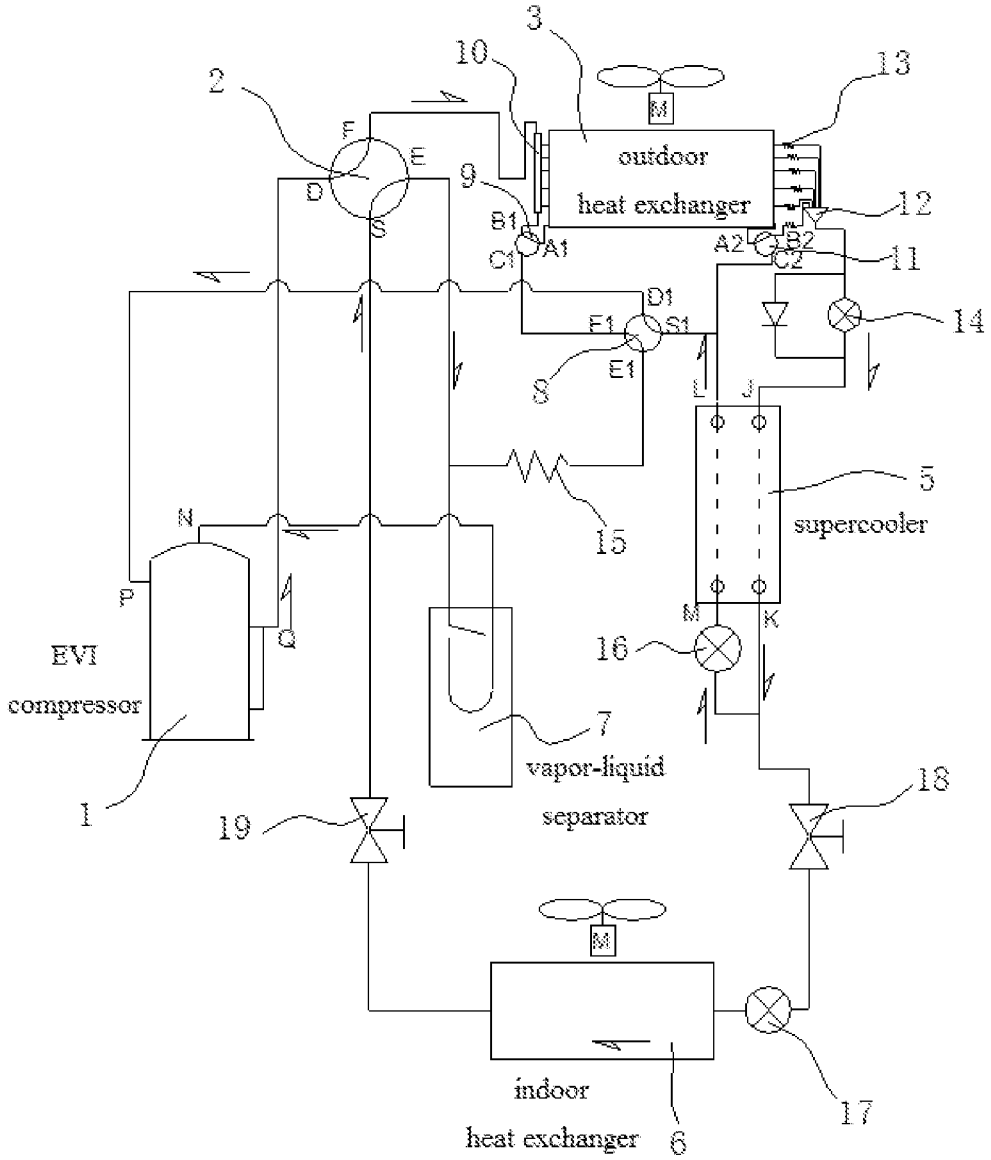
FIG. 4 illustrates the flow direction of a refrigerant of the heat pump system of FIG. 1 in a defrosting mode.

As shown in FIG. 4, in the defrosting mode, the first port D and the second port F of the first four-way valve 2 communicate with each other in the first four-way valve, and the third port E and the fourth port S communicate with each other in the first four-way valve; the first port D1 and the second port F1 of the second four-way valve 8 communicate with each other in the second four-way valve, and the third port E1 and the fourth port S1 communicate with each other in the second four-way valve; the first port A1 and the second port B1 of the first three-way reversing valve 9 communicate with each other in the first three-way reversing valve, and the first port A2 and the second port B2 of the second three-way reversing valve 11 communicate with each other in the second three-way reversing valve. At the moment, the outdoor heat exchanger 3 is entirely used for condensing, dissipating heat and defrosting, namely, the branches of the first heat exchange portion are not occupied. The flow direction of the refrigerant is shown by arrows in FIG. 4. The refrigerant exhausted by the EVI compressor 1 flows to the outdoor heat exchanger 3 via the first four-way valve 2, and then enters the supercooler 5 after passing through the heating electronic expansion valve (namely the first throttling component 14), the refrigerant is divided into two parts in the supercooler 5. One part passes through the first passage of the supercooler 5 and the indoor unit electronic expansion valve (namely the second throttling component 17) in sequence, enters the indoor heat exchanger 6, further enters the vapor-liquid separator 7 via the first four-way valve 2, and finally flows to the inlet port N of the compressor 1 to return to the compressor 1, thereby completing a primary cycle once. And the other part is a part of the medium-temperature high-pressure refrigerant which flows out from the first passage of the supercooler 5, becomes the low-temperature low-pressure gaseous refrigerant under the throttling and depressurizing effect of the supercooler throttling element (namely the supercooler electronic expansion valve) 16, and then is injected to a medium-pressure cavity of the compressor 1 via the fourth port S1 and the first port D1 of the second four-way valve 8, thereby achieving quick defrosting.

Figure 5:
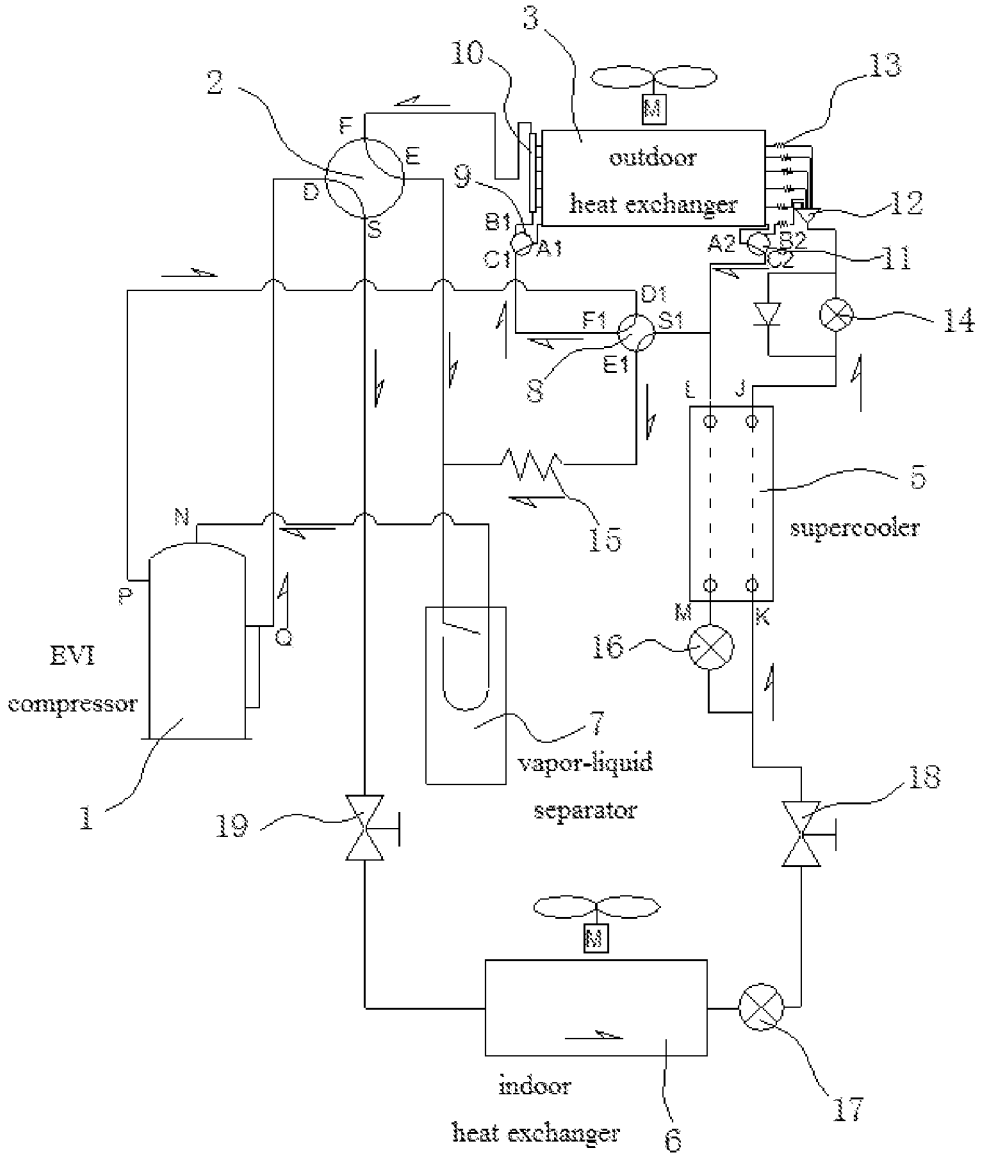
FIG. 5 illustrates the flow direction of a refrigerant of the heat pump system of FIG. 1 in a heating and deicing mode.

As shown in FIG. 5, in the heating and deicing mode, the first port D and the fourth port S of the first four-way valve 2 communicate with each other in the first four-way valve, and the third port E and the second port F communicate with each other in the first four-way valve; the first port D1 and the second port F1 of the second four-way valve 8 communicate with each other in the second four-way valve, and the third port E1 and the fourth port S1 communicate with each other in the second four-way valve; and the first port A1 and the third port C1 of the first three-way reversing valve 9 communicate with each other in the first three-way reversing valve, and the first port A2 and the third port C2 of the second three-way reversing valve 11 communicate with each other in the second three-way reversing valve, namely, the branches of the first heat exchange portion of the outdoor heat exchanger 3 are occupied, and only the branches of the second heat exchange portion are used for evaporating and absorbing heat. The flow direction of the refrigerant is shown by arrows in FIG. 5. In the heating and deicing mode, the refrigerant is also divided into two parts. One part is exhausted by the EVI compressor 1 via the exhaust port Q, flows to the indoor heat exchanger 6 via the first four-way valve 2, then reaches the flow divider 12 via the first passage of the supercooler 5, enters the second heat exchange portion of the outdoor heat exchanger 3, then enters the vapor-liquid separator 7 via the first four-way valve 2, and finally flows to the inlet port N of the compressor to return to the compressor 1, thereby completing a primary circle once. And the other part is the medium-pressure high-temperature gaseous refrigerant which is ejected from a medium-pressure cavity of the compressor 1 via the enhanced vapor injection port P, flows to the first heat exchange portion at the bottom of the outdoor heat exchanger 3 via the first port D1 and the second port F1 of the second four-way valve 8, and the third port C1 and the first port A1 of the first three-way reversing valve 9, to achieve heat exchange at the bottom of the outdoor heat exchanger 3, releasing heat of condensation, and then flows to the vapor-liquid separator 7 via the first port A2 and the third port C2 of the second three-way reversing valve 11, and the fourth port S1 and the third port E1 of the second four-way valve 8.

In conclusion, in the heat pump system of the present disclosure an auxiliary deicing and defrosting effect in the heating mode is achieved through a medium-pressure high-temperature enhanced vapor path (small flow and high temperature), and meanwhile, flexible control can be achieved, that is, during normal heating and cooling operation, the heat exchange area of the outdoor heat exchanger is not occupied, and the heat exchange effect of the outdoor heat exchanger can be exerted to the maximum extent. Therefore, optionally, the heating and deicing mode can be started under the condition that the heating mode is formed after the defrosting mode is finished (namely the first four-way valve 2 achieves switching for heating), that is, the heating and deicing mode is started continuously for a period of time, and when the outdoor unit temperature sensor detects that the temperature of the base plate or the water pan meets a certain temperature condition, the heat pump system quits the heating and deicing mode and returns to the normal heating mode. For example, optionally, the entering conditions of the heating and deicing mode are as follows: after the defrosting mode is finished, namely, after switching the state of the first four-way valve 2 for heating finishes for 5 s, the first three-way reversing valve 9 and the second three-way reversing valve 11 are electrified, so that the respective first ports and third ports communicate with each other in the valves, the first port and the second port of the second four-way valve 8 communicate with each other in the second four-way valve, and the third port and the fourth port of the same communicate with each other in the second four-way valve, and thus the heat pump system enters the heating and deicing mode; and optionally, the exiting condition is that when the temperatures detected by the corresponding temperature sensor within 1 min are all larger than 1 DEG C., the heat pump system exits the heating and deicing mode and enters the heating and non-deicing mode (namely the normal heating mode).

On the basis of the work mentioned above, the second aspect of the present disclosure provides a method for controlling a heat pump system mentioned above, as shown in FIG. 6, including the steps:

S10, enabling the heat pump system to operate in a heating mode; and

S30, switching the flow path switching device to a state to disconnect a first heat exchange portion and a second heat exchange portion, switching the second four-way valve 8 to a state to input a high-temperature refrigerant into the first heat exchange portion, so as to enable the heat pump system to operate in a heating and deicing mode.

In the some embodiments of the heat pump system, a first port D1 of the second four-way valve 8 communicates with the enhanced vapor injection port P of the compressor 1, a second port F1 and a fourth port S1 communicate with two ends of the first heat exchange portion respectively, and a third port E1 communicates with an inlet port N; and under such situation, in the step S30, switching the second four-way valve 8 to the state includes enabling the first port D1 and the second port F1 of the second four-way valve 8 to communicate with each other in the second four-way valve, and the third port E1 and the fourth port S1 of the second four-way valve 8 to communicate with each other in the second four-way valve.

In the some embodiments of the heat pump system, the flow path switching device include a first three-way reversing valve 9 and a second three-way reversing valve 11, and under such situation, in the step S30, switching the flow path switching device to the state includes enabling both the first three-way reversing valve 9 and the second three-way reversing valve 11 to be switched to a second state.

Optionally, the step S10 includes:

switching the flow path switching device to a state to communicate the first heat exchange portion and the second heat exchange portion; switching the second four-way valve 8 to a state to enable the first port D1 and the fourth port S1 of the second four-way valve 8 to communicate with each other in the second four-way valve, and the third port E1 and the second port F1 of the second four-way valve 8 to communicate with each other in the second four-way valve.

Figure 6:
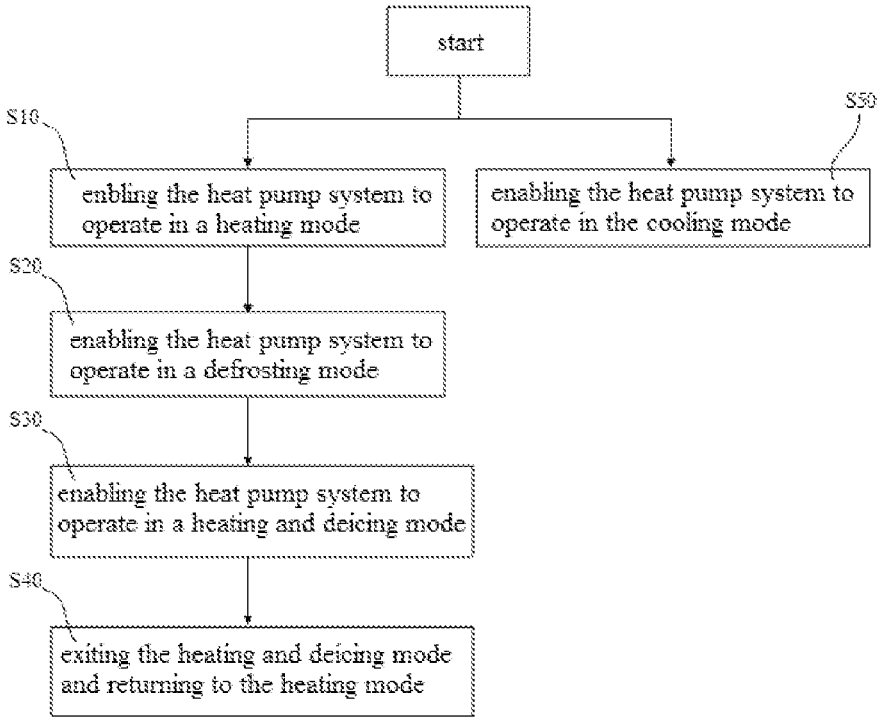
FIG. 6 is a flow chart of a control method for a heat pump system provided by the some embodiments of the present disclosure.

Optionally, as shown in FIG. 6, between the step S10 and the step S30, the method also includes the step:

S20, enabling the heat pump system to operate in a defrosting mode, including: switching the flow path switching device to a state to communicate the first heat exchange portion and the second heat exchange portion, switching the first four-way valve to a state to change the flow direction of a refrigerant, that is, the high-temperature high-pressure refrigerant exhausted by the compressor flows firstly to the outdoor heat exchanger to perform condensation and heat dissipation; and switching the second four-way valve 8 to a state to enable the first port D1 and the second port F1 of the second four-way valve 8 to communicate with each other in the second four-way valve, and the third port E1 and the fourth port S1 of the second four-way valve 8 to communicate with each other in the second four-way valve.

Optionally, in the step S20, after switching the first four-way valve 2 to the state is finished for first predetermined time t1, further switching the first four-way valve 2 to a state to return to the heating mode, and then executing the step S30. The first predetermined time t1 is for example 3-10 s, optionally 5 s.

Optionally, the step S30 includes: after entering the heating and deicing mode, detecting the temperature T of a component (such as the base plate or the water pan of the outdoor unit) positioned on the lower side of the outdoor heat exchanger 3, for example, detecting the temperature via the corresponding temperature sensor, and comparing the temperature T with a preset temperature value a; and when the condition that T is not less than a is always met within second predetermined time t2, executing the step:

S40, exiting the heating and deicing mode, and returning to the heating mode. That is, in this step, the state of the flow path switching device can be firstly switched (for example, both the first three-way reversing valve 9 and the second three-way reversing valve 11 are switched to the first state), to communicating the first heat exchange portion and the second heat exchange portion; the second four-way valve 8 is then switched to a state to enable the first port D1 and the fourth port S1 the second four-way valve 8 to communicate with each other in the second four-way valve, and the third port E1 and the second port F1 the second four-way valve 8 to communicate with each other in the second four-way valve.

Optionally, the second predetermined time t2 is 30-300 s, optionally 60 s; and/or the preset temperature value a is 0.5-2 DEG C., optionally 1 DEG C.

Optionally, as shown in FIG. 6, the method includes the step S50 of enabling the heat pump system to operate in a cooling mode, which includes:

switching the flow path switching device to a state to communicate the first heat exchange portion and the second heat exchange portion; switching the second four-way valve 8 to a state to enable the first port D1 and the second port F1 of the second four-way valve 8 to communicate with each other in the second four-way valve, and the third port E1 and the fourth port S1 of the second four-way valve 8 to communicate with each other in the second four-way valve.

Those skilled in the art will readily appreciate that the various schemes described above can be freely combined and superimposed without conflict.

It should be understood that the above-mentioned embodiments are exemplary only and are not limiting, and that various obvious or equivalent modifications or substitutions may be made by those skilled in the art to the above-mentioned details without departing from the underlying principles of the present disclosure, which are intended to be encompassed within the scope of the claims of the present disclosure

The invention claimed is:

1. A heat pump system, comprising:

a compressor;

an indoor heat exchanger;

an outdoor heat exchanger, comprising a first heat exchange portion and a second heat exchange portion, wherein a flow path switching device is provided between the first heat exchange portion and the second heat exchange portion configured to disconnect or communicate the first heat exchange portion and the second heat exchange portion;

a first four-way valve, configured to switch the flow direction of a refrigerant between the outdoor heat exchanger and the indoor heat exchanger; and a second four-way valve, configured to enable a high-temperature refrigerant to be input into the first heat exchange portion in a heating mode, so as to enable the heat pump system to operate in a heating and deicing mode;

wherein the compressor comprises an enhanced vapor injection port and an inlet port, and in the heating and deicing mode, the second four-way valve is configured to enable the first heat exchange portion to be connected between the enhanced vapor injection port and the inlet port.

2. The heat pump system of claim 1, wherein the first heat exchange portion is positioned at the bottom of the outdoor heat exchanger, and the second heat exchange portion is positioned above the first heat exchange portion.

3. The heat pump system of claim 1, wherein the second four-way valve comprises a first port, a second port, a third port and a fourth port, the first port communicates with the enhanced vapor injection port, the second port and the fourth port communicate with two ends of the first heat exchange portion respectively and the third port communicates with the inlet port.

4. The heat pump system of claim 3, wherein the flow path switching device comprises a first three-way reversing valve arranged at a first end of the first heat exchange portion, and a second three-way reversing valve arranged at a second end of the first heat exchange portion; and a throttling member is arranged between the third port and the inlet port; or the flow path switching device comprises a first three-way reversing valve arranged at the first end of the first heat exchange portion, and a second three-way reversing valve arranged at a second end of the first heat exchange portion.

5. The heat pump system of claim 4, wherein a collecting pipe is arranged at a first end of the outdoor heat exchanger, the collecting pipe communicates with the second heat exchange portion, a first end of the first heat exchange portion is configured to communicate with the collecting pipe in a first state of the first three-way reversing valve, and the first end of the first heat exchange portion is configured to communicate with the second port of the second four-way valve in a second state of the first three-way reversing valve; and a flow divider is arranged at a second end of the outdoor heat exchanger, the flow divider communicates with the second heat exchange portion, a second end of the first heat exchange portion is configured to communicate with a splitting branch of the flow divider in a first state of the second three-way reversing valve, and the second end of the first heat exchange portion communicates with the fourth port of the second four-way valve in a second state of the second three-way reversing valve; or a collecting pipe is arranged at a first end of the outdoor heat exchanger, the collecting pipe communicates with the second heat exchange portion, a first end of the first heat exchange portion is configured to communicate with the collecting pipe in a first state of the first three-way reversing valve, and the first end of the first heat exchange portion is configured to communicate with the second port of a second four-way valve in the second state of the first three-way reversing valve.

6. The heat pump system of claim 5, wherein the second heat exchange portion comprises a plurality of heat exchange pipes in parallel; and a first end of each heat exchange pipe communicates with the collecting pipe, and a second end of each heat exchange pipe communicates with one splitting branch of the flow divider respectively; or a second end of each heat exchange pipe communicates with one splitting branch of the flow divider respectively.

7. The heat pump system of claim 6, wherein a throttling element is arranged in each splitting branch of the flow divider.

8. The heat pump system of claim 5, wherein the second heat exchange portion comprises a plurality of heat exchange pipes in parallel; and a first end of each heat exchange pipe communicates with the collecting pipe.

9. The heat pump system of claim 4, wherein a flow divider is arranged at a second end of the outdoor heat exchanger, the flow divider communicates with the second heat exchange portion, a second end of the first heat exchange portion is configured to communicate with a splitting branch of the flow divider in a first state of the second three-way reversing valve, and the second end of the first heat exchange portion communicates with the fourth port of the second four-way valve in a second state of the second three-way reversing valve.

10. The heat pump system of claim 3, comprising a supercooler comprising a first passage and a second passage; wherein a first end and a second end of the first passage communicate with the outdoor heat exchanger and the indoor heat exchanger respectively; a first end of the second passage communicates with the fourth port of the second four-way valve; and a second end of the second passage communicates with the second end of the first passage via a supercooler throttling element.

11. The heat pump system of claim 10, wherein a first throttling component is arranged between the supercooler and the outdoor heat exchanger, and a second throttling component is arranged between the supercooler and the indoor heat exchanger; or a first throttling component is arranged between the supercooler and the outdoor heat exchanger; or a second throttling component is arranged between the supercooler and the indoor heat exchanger.

12. The heat pump system of claim 3, wherein a throttling member is arranged between the third port and the inlet port.

13. The heat pump system of claim 1, wherein a first stop valve and a second stop valve are arranged at two ends of the indoor heat exchanger respectively; and a vapor-liquid separator is arranged between the inlet port and the first four-way valve; or a first stop valve and a second stop valve are arranged at two ends of the indoor heat exchanger respectively; or a vapor-liquid separator is arranged between the inlet port and the first four-way valve.

14. A method for controlling the heat pump system of claim 1, comprising following steps:

S10, enabling the heat pump system to operate in the heating mode; and

S30, switching the flow path switching device to a state to disconnect the first heat exchange portion and the second heat exchange portion, and switching the second four-way valve to a state to input a high-temperature refrigerant into the first heat exchange portion, so as to enable the heat pump system to operate in the heating and deicing mode.

15. The method of claim 14, wherein a first port of the second four-way valve communicates with an enhanced vapor injection port of the compressor, a second port and a fourth port of the second four-way valve communicates with two ends of the first heat exchange portion respectively, and a third port of the second four-way valve communicates with an inlet port of the compressor; and in the step S30, switching the second four-way valve to the state comprises enabling the first port and the second port to communicate with each other in the second four-way valve, and the third port and the fourth port to communicate with each other in the second four-way valve.

16. The method of claim 15, wherein the step S10 comprises:

switching the flow path switching device to a state to communicate the first heat exchange portion and the second heat exchange portion; and switching the second four-way valve to a state to enable the first port and the fourth port to communicate with each other in the second four-way valve, and the third port and the second port to communicate with each other in the second four-way valve; or switching the flow path switching device to the state to communicate the first heat exchange portion and the second heat exchange portion; or switching the second four-way valve to the state to enable the first port and the fourth port to communicate with each other in the second four-way valve, and the third port and the second port to communicate with each other in the second four-way valve.

17. The method of claim 15, further comprising following step: enabling the heat pump system to operate in a cooling mode, comprising:

switching the flow path switching device to a state to communicate the first heat exchange portion and the second heat exchange portion; and switching the second four-way valve to a state to enable the first port and the second port to communicate with each other in the second four-way valve, and the third port and the fourth port to communicate with each other in the second four-way valve; or switching the flow path switching device to the state to communicate the first heat exchange portion and the second heat exchange portion; or switching the second four-way valve to the state to enable the first port and the second port to communicate with each other in the second four-way valve, and the third port and the fourth port to communicate with each other in the second four-way valve.

18. The method of claim 14, wherein between the step S10 and the step S30, the method further comprises the following step:

S20, enabling the heat pump system to operate in a defrosting mode, comprising: switching the flow path switching device to a state to communicate the first heat exchange portion and the second heat exchange portion, switching the first four-way valve to a state to change the flow direction of the refrigerant, and switching the first four-way valve to a state to operate in the heating mode after first predetermined time; and then executing the step S30.

19. The method of claim 14, wherein the step S30 comprises: in the heating and deicing mode, detecting the temperature of a component positioned on the lower side of the outdoor heat exchanger, and comparing the temperature with a preset temperature value; and under the condition that the temperature is not less than the preset temperature is always met within second predetermined time, executing following step:

S40, exiting the heating and deicing mode and returning to the heating mode.

20. The method of claim 19, wherein the second predetermined time is 30-300 s; and the preset temperature value is 0.5-2 DEG C.; or the second predetermined time is 30-300 s; or the preset temperature value is 0.5-2 DEG C.

* * * * *